US005131204A

United States Patent [19]

Hiendl

[11] Patent Number: 5,131,204

[45] Date of Patent: Jul. 21, 1992

[54] REINFORCING STEEL CONNECTION

[76] Inventor: Heribert Hiendl, Gerhart-Hauptmann-Strasse 19, 8440 Straubing, Fed. Rep. of Germany

[21] Appl. No.: 500,307

[22] Filed: Apr. 17, 1990

Related U.S. Application Data

[63] Continuation of Ser. No. 471,969, Jan. 11, 1990, abandoned.

[30] Foreign Application Priority Data

Jan. 17, 1989 [DE] Fed. Rep. of Germany ..... 3901142
Apr. 7, 1989 [DE] Fed. Rep. of Germany ..... 3911331

[51] Int. Cl.[5] ..... E04C 5/00; F16B 35/00; F16B 7/18

[52] U.S. Cl. ..... 52/726; 403/307; 403/343; 411/366; 411/426

[58] Field of Search ..... 52/726, 707, 704, 230; 29/897.34; 411/366, 411, 424, 426; 403/307, 343; 285/333-334

[56] References Cited

U.S. PATENT DOCUMENTS

| | | | |
|---|---|---|---|
| 3,079,181 | 2/1963 | Van Der Wissel | 285/333 |
| 3,167,882 | 2/1965 | Abbott | 52/230 |
| 4,063,838 | 12/1977 | Michael | 403/343 |
| 4,687,368 | 8/1987 | Eklof et al. | 403/307 X |
| 4,769,886 | 9/1988 | Berchem et al. | 29/897.34 |
| 4,904,136 | 2/1990 | Matsumoto | 411/366 X |

FOREIGN PATENT DOCUMENTS

| | | | |
|---|---|---|---|
| 199656 | 6/1908 | Fed. Rep. of Germany | 403/343 |

*Primary Examiner*—Michael Safavi
*Attorney, Agent, or Firm*—Hoffman, Wasson and Gitler

[57] ABSTRACT

A sleeveless screw connection between two reinforcing steel elements includes a conical tapped hole in one end of one of the elements, and a conical externally threaded end on the other element. The surface of each thread envelope makes an angle of between 3° and 10° with the axis of the respective element; the thread pitch is between 1.0 and 2.5 mm, and the thread angle is between 70° and 90°.

23 Claims, 5 Drawing Sheets

REINFORCING STEEL CONNECTION

This application is a continuation-in-part application of Ser. No. 07/471,969, filed Jan. 11, 1990 now abandoned.

BACKGROUND OF THE INVENTION

The invention relates to a sleeveless connection of at least two lengths of a reinforcing steel.

Threaded reinforcing steel connections or reinforcing steel joints are known that use sleeves made as threaded bushes. These connections are expensive not only in their production and use, but further also have the drawback that the sleeves used exhibit an outer diameter that is considerably larger compared to the active cross section of the reinforcing steels, so that, among other things, in many cases problems arise with respect to sufficient concrete covering.

SUMMARY OF THE INVENTION

An object of the invention is to provide a threaded reinforcing steel connection that can be produced simply and economically.

To achieve this object, a reinforcing steel connection (reinforcing steel joint) is made according to the invention so that the connection is made as a sleeveless screw connection with a conical threaded section on the other length engaging in a tapped hole, preferably in a conical tapped hole, in the one length, or so that the connection is made as a sleeveless screw connection with a threaded section on the other length engaging in a tapped hole on the one length and at the same time also as an adhesive or soldered connection.

In the connection according to the invention, the conical threaded section (with external thread) is made directly on the one end of the other length of reinforcing steel, and specifically preferably by applying or cutting the thread with a suitable tool that is also available at the place of use (construction site) and can be handled there simply and conveniently. Cutting the conical threaded part on the other length of the reinforcing steel just at the place of use (construction site) also has the advantage that this other length of the structural steel can be optimally matched to the respective requirements at the construction site.

The conical tapped hole provided on the one length of the reinforcing steel is also inserted directly in an end of this length of the reinforcing steel, and specifically preferably with a machine tool suitable for this purpose (e.g., a lathe or an automatic lathe).

In a preferred embodiment of the invention, the other length provided with the thread lug exhibits a diameter that is smaller than the diameter of the length of the structural steel provided with the associated tapped hole.

In another embodiment of the invention, an adhesive or soldered connection is used in addition to the screw connection. This additional adhesive or soldered connection first prevents a loosening of the screw connection, but above all counteracts, with dynamic loads on the connection, a "swinging" of the screw connection, i.e., local symptoms of fatigue, and keeps the screw connection free of dynamic forces to the greatest extent so that the connection, seen overall, i.e., by the combination of screw connection and adhesive or soldered connection, exhibits a high loading capacity and also especially a high fatigue limit.

At least that length of reinforcing steel having the recess provided with the female thread consists of a thermally treated reinforcing steel, i.e., of a reinforcing steel that is produced according to the so-called "Tempcore process" and exhibits a harder, outer cross section area and a softer core surrounded by this cross section area. The harder cross section area of greater strength lies here also radially outside the recess exhibiting the female threaded section, i.e., the latter is surrounded by the harder cross section area so that in this way optimal conditions result With respect to load transmission, especially also With respect to the transmission of tensile load as well as torque transmission and thus to an optimal loading capacity of the sleeveless, threaded reinforcing steel connection.

The screw connection according to the invention can be used in an especially advantageous way as a connection reinforcement or a reinforcing connection.

BRIEF DESCRIPTION OF THE DRAWINGS

The invention is described below based on the embodiments shown in the accompanying drawings. There are shown in:

FIG. 8 similar embodiments such as FIGS. 6 and 7, but using a cylindrical tapped hole and a cylindrical threaded section.

DESCRIPTION OF THE PREFERRED EMBODIMENT

Figure 1:
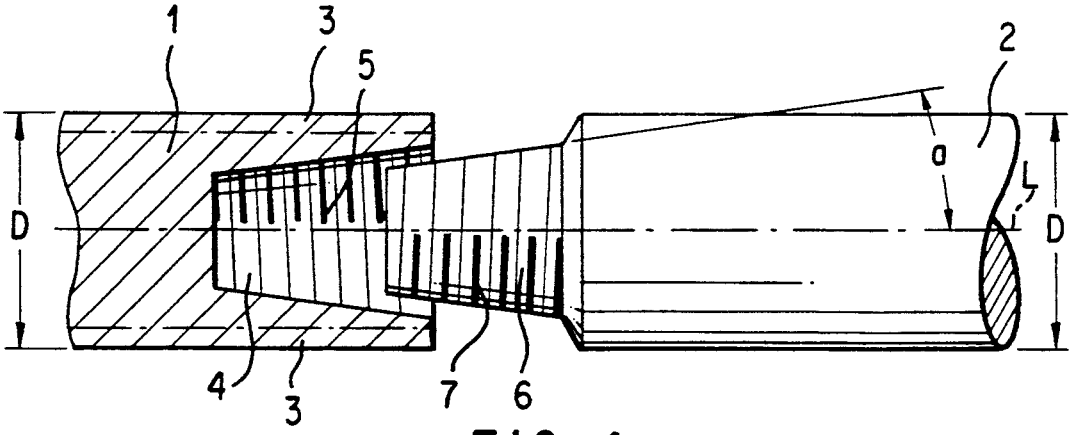
FIG. 1, in diagrammatic representation and in section, a screw connection between two lengths of a reinforcing steel with the same cross section.
Figure 2:
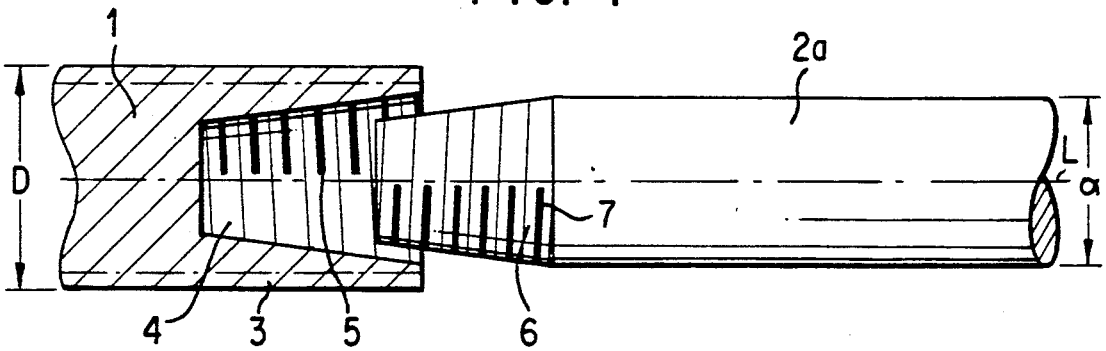
FIG. 2, in diagrammatic representation and in section, a screw connection between two lengths of a reinforcing steel with different cross section.

In FIG. 1, 1 and 2 are two reinforcing steels of which at least reinforcing steel 1 is a heat-treated reinforcing steel produced, e.g., according to the so-called "TEMPCORE process" and consequently exhibits an outer cross section zone 3 of especially high strength.

Into the one front end of reinforcing steel 1 there is inserted a frustum-shaped recess 4 that lies with its axis even with the lengthwise axis of reinforcing steel 1 and that is provided with an inner thread 5 and thus forms a frustum-shaped tapering or conical tapped hole.

Reinforcing steel 2 is provided on one end with a frustum-shaped, tapering attachment 6, whose axis is even with the axis of reinforcing steel 2. Attachment 6 that fits in recess 4 is provided on its outer surface with an external thread 7 so that attachment 6 forms a frustum-shaped threaded part that can be screwed into recess 4 to connect two reinforcing steels 1 and 2 or both lengths of these reinforcing steels.

In the embodiment represented, the peripheral or jacket surface of attachment 6 and consequently also the frustum-shaped or conical peripheral surface of recess 4 enclose an angle a in the range between 3° and 10°, with lengthwise axis L of respective reinforcing steel 1 or 2.

The conical or frustum-shaped screw connection formed by recess 4 and in attachment 6 has a series of advantages, among others the advantage that, despite the same or at least essentially the same cross section D of reinforcing steels 1 and 2 and, despite only a slightly smaller cross section d of attachment 6 on its base, i.e., where this attachment 6 merges into the rest of the length of reinforcing steel 2, compared to cross section D, a sleeveless screw connection is possible that does not exhibit an enlarged outer diameter even at the joint between reinforcing steels 1 and 2 and thus does not cause the problems that often result with respect to the concrete covering in reinforcing steel screw connections using sleeves. Further, the conical screw connection assures that, with cross section conditions at the joint between reinforcing steels 1 and 2 that are optimal for the transmission of tensile load, these reinforcing steels engage in one another over a relatively large surface at threads 5 and 7 and also the diameter of recess 4 and of attachment 6 is relatively large over the entire connection area.

While in the embodiment represented in FIG. 1 both reinforcing steels 1 and 2 exhibit essentially the same diameter D, FIG. 2 shows a preferred embodiment of the invention, i.e., a sleeveless, threaded connection between reinforcing steel 1 with diameter D and reinforcing steel 2*a* that exhibits, compared to diameter D, a smaller diameter d. The elements of the screw connection according to FIG. 2 are the same as in the screw connection according to FIG. 1, i.e., the screw connection according to FIG. 2 exhibits recess 4 provided with internal thread 5 in reinforcing steel 1 and conical or frustum-shaped attachment 6, provided with the external thread, on the one end of the length of reinforcing steel 2*a*. In the connection according to FIG. 2, smaller diameter d results in especially favorable conditions, especially also with respect to the static and dynamic loading capacity.

Figure 3:
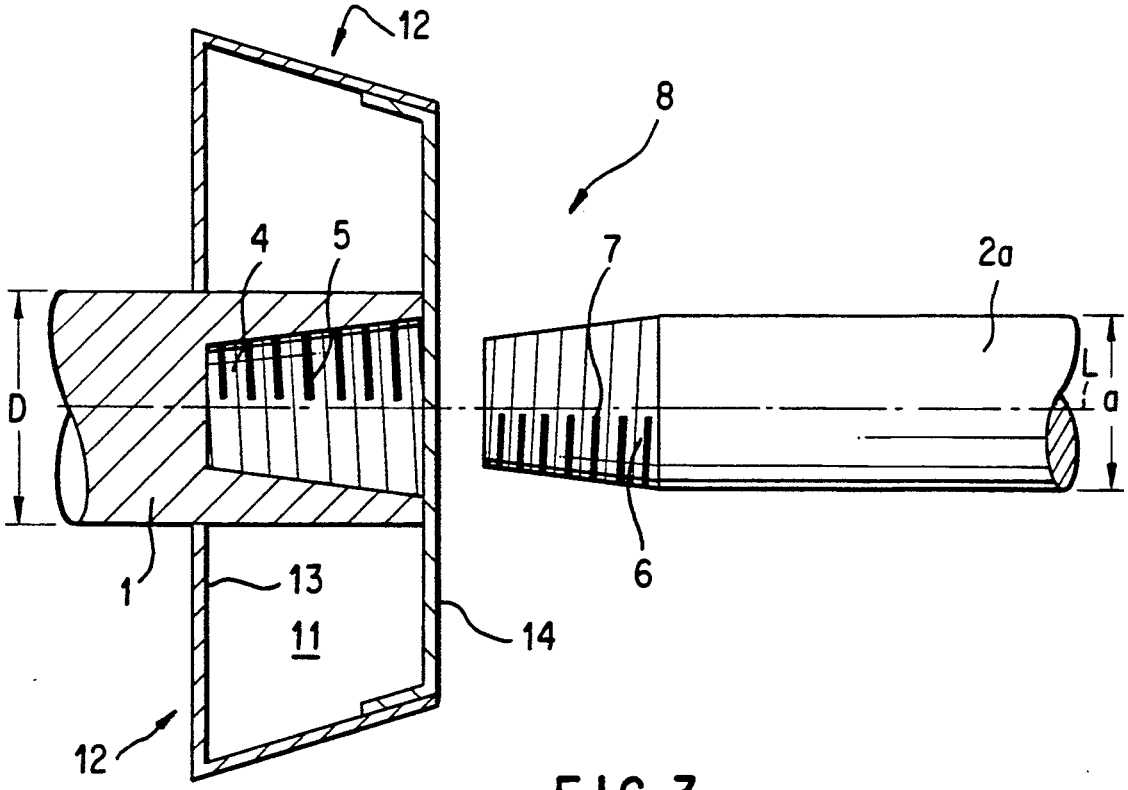
FIG. 3, the reinforcing steel connection according to FIG. 2 in its embodiment as a reinforcing connection.
Figure 4:
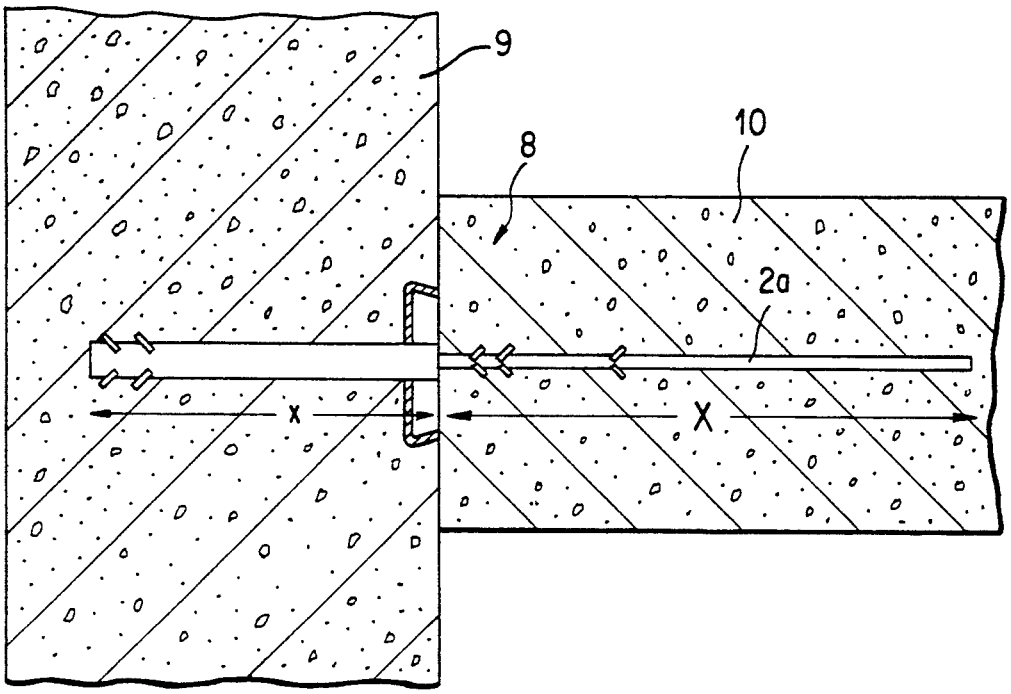
FIG. 4, a section through two adjacent concrete structures.

FIG. 3 shows a sleeveless screw connection in which reinforcing steels 1 and 2*a* form parts of a connection reinforcement or a reinforcing connection 8 that is used where another concrete structural element, for example a concrete wall 10 running at a right angle to concrete wall 9, is to be attached to a previously produced concrete structural element, for example to a concrete wall 9 (FIG. 4). Reinforcing connection 8 is used here so that the length of reinforcing steel 1 with larger diameter D is embedded during production of concrete wall 9 into the concrete of this concrete wall so that, after the release of concrete wall 9, the end of reinforcing steel 1 provided with recess 4 is accessible. Reinforcing steel 1 here forms the anchoring part of connection reinforcement or reinforcing connection 8 to be placed in concrete wall 9.

After the release of concrete wall 9, reinforcing steel 2*a* with attachment 6 is screwed into recess 4 and then, as a connecting part of connection reinforcement or of reinforcing connection 8, is embedded or integrated into the concrete there during production of concrete wall 10. To avoid penetration of concrete into recess 4 of reinforcing steel 1 during production of concrete wall 9, this reinforcing steel is placed with its end provided with recess 4 in interior space 11 of a boxlike flashing element 12, and specifically just like the corresponding ends of other reinforcing steels 1. All reinforcing steels then project outward above a common bottom 13 of flashing element 12, as is known in the art in reinforcing connections for the anchoring parts. After the release of concrete wall 9, flashing element 12 is opened by removing a cover 14, so that then the ends of reinforcing steels 1 provided with recesses 4 are accessible each for screwing in a reinforcing steel 2*a*.

Since the integration of reinforcing steel 1 or 2*a* in the concrete with predetermined profiling depends essentially on the surface of reinforcing steel 1 or 2*a* enclosed by the concrete and thus is proportional not only to the length, but also to diameter D or d of the respective reinforcing steel, length x of reinforcing steel 1 can be selected considerably smaller than length X of reinforcing steel 2*a*. The use of reinforcing steel 1 as an anchoring part thus has the advantage that, despite the necessary matching of length x of the reinforcing steel to the thickness of concrete wall 9 such that length x is smaller than the thickness of concrete wall 9, an optimal integration of the elements of the connection reinforcement formed by reinforcing steels 1 and 2*a* into concrete walls 9 and 10 and thus an optimal load transmission in the area of the connecting reinforcement are achieved. Since reinforcing steel 2*a* forming the connecting part extends in concrete wall 10 essentially parallel to the top sides of this concrete wall, length X of reinforcing steel 2*a* practically doesn't matter. Seen overall, reinforcing connection 8 formed by reinforcing steels 1 and 2*a* also has the advantage that, with simple handling and production, especially with dispensing with threaded sleeves, the bending back of bent connecting parts, which greatly impairs the fatigue limit of reinforcing steels, is not necessary. Of course, it is possible also to provide, instead of flashing element 12, other suitable means by which, after the release of the first produced concrete part, i.e., concrete wall 9, recess 4 of the respective length of structural steel 1 is accessible.

Figure 5:
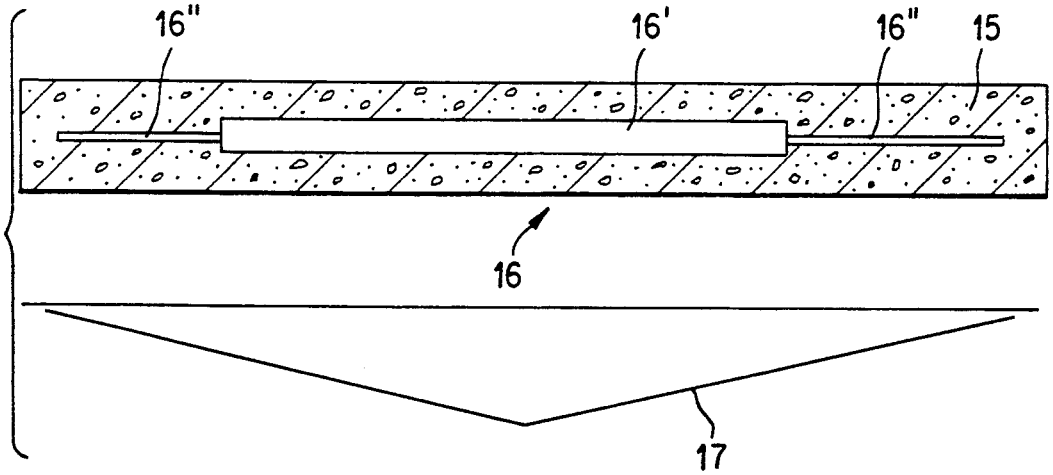
FIG. 5, in diagrammatic representation, a concrete reinforcement consisting of three adjacent lengths of reinforcing steel with different diameters connected to one another in each case by a screw connection.

As shown in FIG. 5, it is in particular also possible with the screw connection according to the invention optimally to match the steel cross section or the cross section of a concrete reinforcement to the moments in a concrete structural element. In FIG. 5, element 15 is a concrete structural element in the form of a concrete beam or girder. Numeral 16 designates generally a reinforcing steel arrangement provided in concrete structural element 15 and forming a part of the reinforcement there, an arrangement that extends in the lengthwise direction of concrete structural element 15. Corresponding to the assumed course of the moment with a maximum lying in the middle of concrete structural element 15, reinforcing steel arrangement 16 consists of an average length 16' of reinforcing steel 1 with larger diameter D. A length 16'' of reinforcing steel 2*a* with smaller diameter d is attached on each end of length 16' by a sleeveless, conical screw connection corresponding to FIG. 2.

Figure 6:
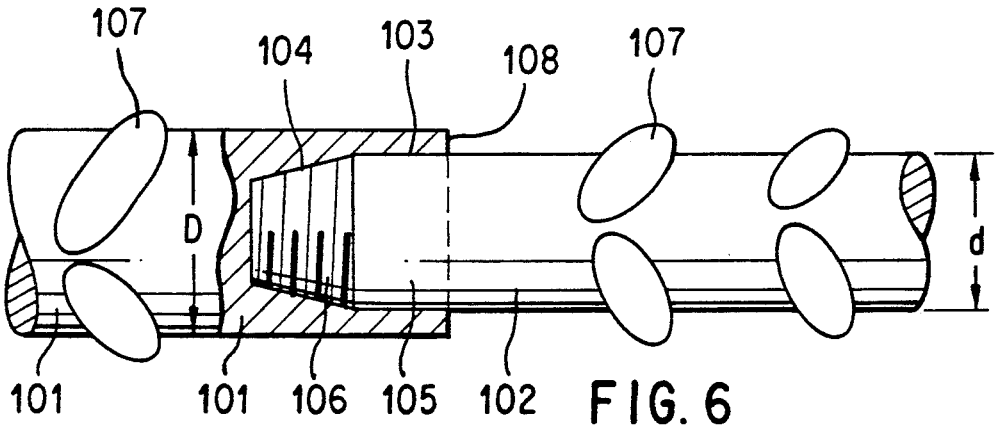

In FIG. 6, elements 101 and 102 are two reinforcing steels, of which at least reinforcing steel 101 is a reinforcing steel heat-treated, e.g., according to the so-called "Tempcore process" and consequently exhibits an outer cross section zone of especially high strength. Into the one front end of reinforcing steel 101 there is inserted a recess lying with its axis even with the lengthwise axis of this reinforcing steel, a recess that is made of a circular cylindrical section 103 and of a frustum-shaped section 104 lying further inward, and the end of section 104 exhibiting the smaller diameter forms the bottom of the recess formed by sections 103 and 104.

Reinforcing steel 102 extends with one end into the above-mentioned recess, i.e., in the area of this one end, reinforcing steel 102 is provided with a circular cylindrical section 105, which is held by section 103, as well as with a frustum-shaped section 106, which has an external thread and with which reinforcing steel 102 is screwed into the internal thread of section 104.

As shown in FIGS. 6–9, the reinforcing steel 102, 102*a* has an outer diameter at cylindrical section 105 equal to the diameter of the recess forming circular cylindrical section 103. Since in the embodiment according to FIG. 6 reinforcing steel 102 exhibits an outer diameter d that is smaller anyhow than outer diameter D of reinforcing steel 101, reinforcing steel 102 at section 105 is turned only slightly on its outer surface to remove there ribs 107 otherwise provided on reinforcing steel 102, but also on reinforcing steel 101, and to achieve an outer cross section for section 105 that fits as exactly as possible into section 103. In the area of the actual screw connection between section 104 and section 106, but above all in the area of section 103 and section 105, both reinforcing steels 101 and 102 are connected to one another using a suitable adhesive. This additional adhesive connection has the advantage that, with it, not only is a possible loosening of the screw connection effectively counteracted, but with it a considerable improvement or increase in the fatigue limit of the reinforcing steel connection is achieved. Dynamic loads between both reinforcing steels 101 and 102 are transmitted for the most part already through the adhesive connection. Further, the type of connection described also yields a considerable improvement in the breaking and bending strength, and specifically especially also because, by section 103 of the recess of reinforcing steel 101 and by section 105 of reinforcing steels engage in one another to relatively great lengths. The axial lengths of section 104 or of section 105 is, for example, 20 mm.

Figure 7:
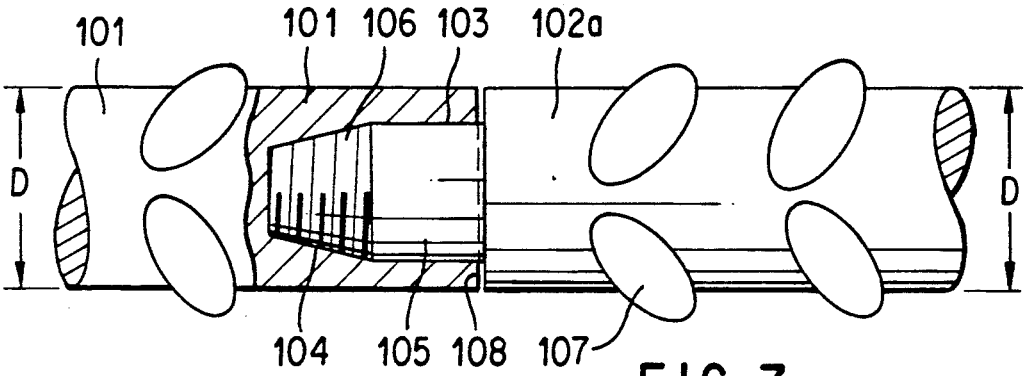
FIG. 7, in the same representation as in FIG. 6, a modified embodiment using reinforcing steels with the same cross section.
Figure 8:
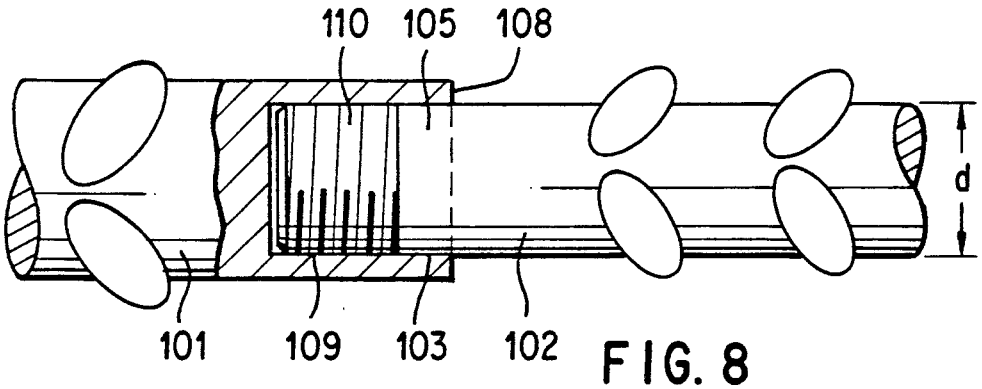
FIG. 8, in diagrammatic representation and partially in section, another sleeveless screw connection between two lengths of a reinforcing steel with different cross section, and the screw connection exhibits a conical tapped hole as well as a conical threaded section engaging in the latter.

The embodiment represented in FIG. 7 differs from the embodiment according to FIG. 6 only in that, instead of reinforcing steel 102, a reinforcing steel 102*a* is used that exhibits the same outer diameter D as reinforcing steel 101. To be able to connect reinforcing steel 102*a* to reinforcing steel 101 in the way described above, reinforcing steel 102*a* is turned in the area of its one end to achieve section 105 with the cross section that fits into section 103. Further, reinforcing steel 102*a* is again provided with frustum-shaped, tapering section 106 exhibiting the external thread. In the embodiment according to FIG. 7, front-end annular surface 108 enclosing the recess in reinforcing steel 101, interacting with a corresponding annular surface on reinforcing steel 102*a* enclosing section 105, yields an additional adhesive area.

Figure 9:
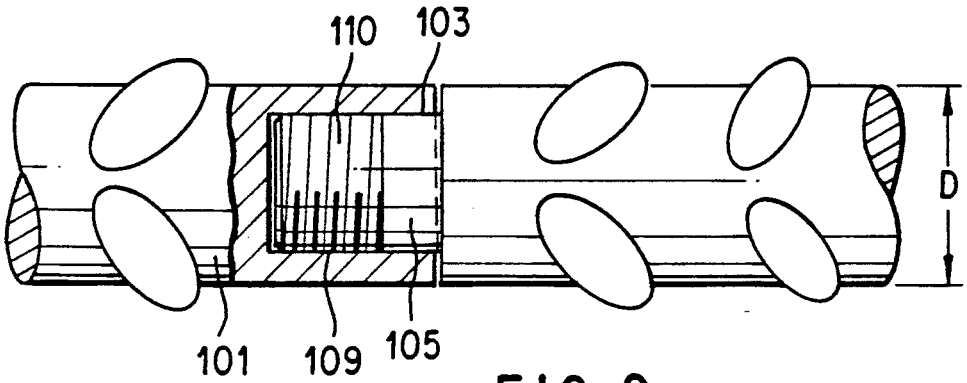
FIG. 9, a modified embodiment of the connection shown in FIG. 8 with reinforcing steels having the same diameter.

The embodiments according to FIGS. 8 and 9 correspond to the embodiment described above, among other things in that, as FIG. 8 shows a screw connection between reinforcing steel 101 and reinforcing steel 102 with smaller diameter d, while FIG. 9 represents a screw connection between reinforcing steel 101 and reinforcing steel 102*a* with diameter D. Different from the embodiments according to FIGS. 6 and 7 is only the fact that a screw connection formed from cylindrical elements is provided, i.e., the recess in reinforcing steel 101 exhibits, instead of section 104, a cylindrical section 109 provided with a female thread and in which section 110 on reinforcing steel 102 (FIG. 8) or on reinforcing steel 102*a* (FIG. 9), a section that is provided with the external thread and is also circular cylindrical, engages.

In the reinforcing steel connections according to FIG. 6–9, instead of the additional adhesive connection, an additional soldering connection can also be provided, and specifically using a solder with a melting point on the order of about 300° C. In any case, the melting point is to be selected so that, during soldering, the properties of the reinforcing steel at the joint are not changed.

The reinforcing steel connections represented in FIG. 6–9 can also be used for the most varied purposes in steel concrete construction. Basically, these connections or reinforcing steels 101 and 102 or 102*a* used there can also each be part of a connection reinforcement or of a reinforcing connection, as was described above in conjunction with FIG. 5.

Figure 10:
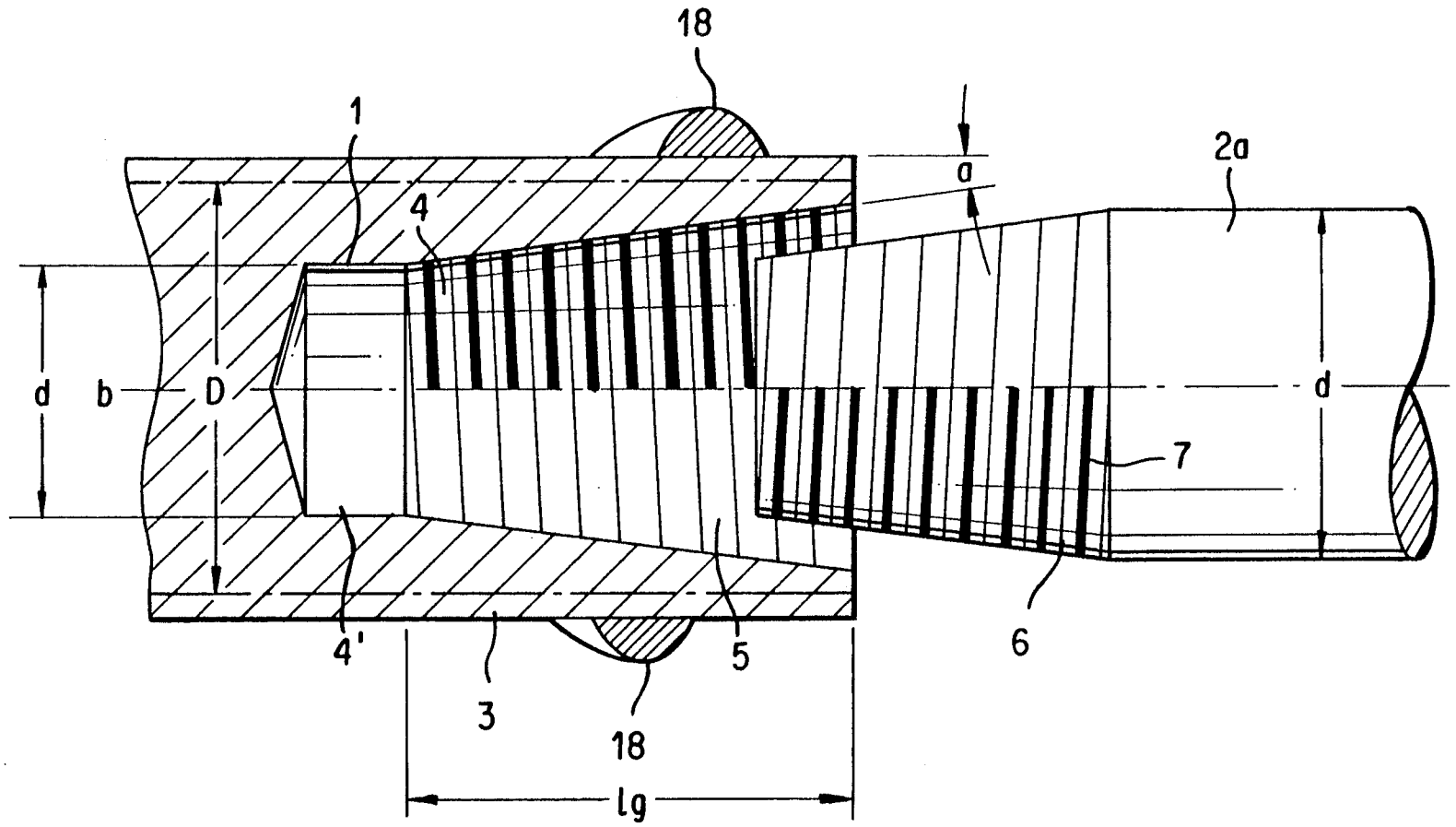
FIG. 10, in a diagrammatic representation, a modified embodiment of the connection shown in FIG. 2 with ribbing.

The connection shown in FIG. 10 is substantially similar to that shown in FIG. 2 with the exception that the reinforcing steel 1 includes ribbing 18. This figure shows conical threaded section 6 having a length lg which is preferably about 1.1 to 4.7 times the diameter of the reinforcing steel forming said other rod.

Figure 11:
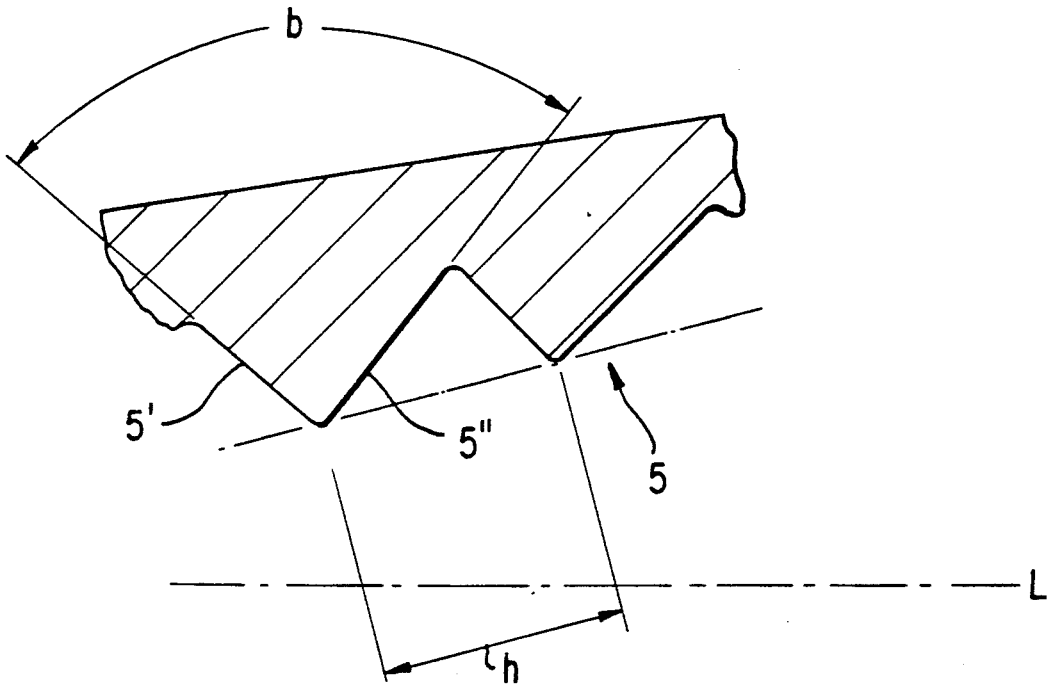
FIG. 11, in a partial cross-section of the threading shown in FIGS. 1–3.

FIG. 11 shows a partial cross-section view of the internal threads 5 shown in FIGS. 1–3. Threads 5 include a first thread face 5' and a second thread face 5'' which produce a screw thread angle b between 70° and 90°. Further, the preferred thread pitch h is between 1.0 and 2.5 mm.

Inasmuch as the only presently preferred embodiments of the invention have been described above, it should be understood that various changes and modifications are possible, within the scope of the claims that follow.

I claim:

1. A sleeveless screw connection between two reinforcing steel rods, comprising a conical tapped hole in one of the rods and a conical threaded section on the other rod, said conical section engaging said hole, wherein the inner surface of the conical tapped hole and the envelope surface of the conical threaded section enclose an angle (a) of between about 3° and 10° with the longitudinal axis of the rods, with said conical threaded section and said conical tapped hole each having a thread having a thread pitch (h) approximately between 1.0 and 2.5 mm and having a screw thread angle (b) between about 70° and 90°.

2. A connection according to claim 1, wherein the inner surface of the conical tapped hole and the envelope surface of the conical threaded section enclose an angle (a) between about 3° and 4° with said longitudinal axis.

3. A connection according to claim 2, wherein the inner surface of the conical tapped hole and the envelope surface of the conical threaded section enclose an angle (a) of about 3° with said longitudinal axis.

4. A connection according to claim 2, wherein the inner surface of the conical tapped hole and the envelope surface of the conical threaded section enclose an angle (a) of about 4° with said longitudinal axis.

5. A connection according to claim 1, wherein said conical threaded section and said conical tapped hole form a fine thread having a thread pitch of about 1.2 mm.

6. A connection according to claim 1, wherein said conical threaded section and said conical tapped hold form a thread having a screw angle (b) of about 90°.

7. A connection according to claim 1, wherein at least the reinforcing steel forming said one rod is a heat-treated steel comprising an outer cross section zone having a higher strength than the reinforcing steel core surrounded thereby, and wherein at least one of said tapped hole and said conical threaded section is formed in the material of the reinforcing steel core.

8. A connection according to claim 1, wherein the axial length of the threaded conical section equals at least 1.1 times the diameter of the reinforcing steel forming said other rod.

9. A connection according to claim 8, wherein said axial length of the conical threaded section is preferably about 1.1 to 4.7 times said diameter.

10. A connection according to claim 8, wherein the axial length of said conical threaded section equals about 1.25 to 1.5 times the diameter of the reinforcing steel forming said other rod.

11. A connection according to claim 1, wherein both of said rods form a reinforcing connection with an anchoring part to be anchored in a first concrete structural element to be produced first and with a connecting part to be anchored in a second concrete structural element to be added.

12. A connection according to claim 11, wherein said rods are of unequal diameter, the rod having the larger diameter forms the anchoring part, and the other length of reinforcing steel with smaller diameter forms the connecting part.

13. A connection according to claim 12, wherein the reinforcing steel rod forming the connecting part has a greater length than the reinforcing steel rod forming the anchoring part.

14. A connection according to claim 1, wherein the threaded section is applied directly to the other length of the reinforcing steel.

15. A connection according to claim 1, wherein said conical threaded section and said conical tapped hole form a multiple fine thread or multiple thread having a screw thread angle (b) of about 90°.

16. A sleeveless screw connection between at least two reinforcing steel rods, comprising a conical tapped hole inserted directly in one of the rods and a conical threaded section applied directly to the other rod, said conical threaded section engaging said conical tapped hole, wherein the inner surface of the conical tapped hole and the envelope surface of the conical threaded section enclose an angle between about 3° and 4° with the longitudinal axis of the rods, with said conical threaded section and said conical tapped hole each having a thread pitch (h) between 1.0 and 2.5 mm and a screw thread angle (b) of about 90°.

17. A connection according to claim 16, wherein the inner surface of the conical tapped hole and the envelope surface of the conical threaded section enclose an angle (a) of about 3° with said longitudinal axis.

18. A connection according to claim 16, wherein the inner surface of the conical tapped hole and the envelope surface of the conical threaded section enclose an angle (a) of about 4° with said longitudinal axis.

19. A connection according to claim 16, wherein said conical threaded section and said conical tapped hole form a fine thread having a thread pitch of about 1.2 mm.

20. A connection according to claim 16, wherein the axial length of the threaded conical section equals about 1.1 times to 4.7 times the diameter of the reinforcing steel forming said other rod.

21. A connection according to claim 16, wherein the axial length of said conical threaded section equals about 1.25 to 1.5 times the diameter of the reinforcing steel forming said other rod.

22. A connection according to claim 16, wherein both of said rods form a reinforcing connection with an anchoring part to be anchored in a first concrete structural element, to be produced first, and with a connecting part to be anchored in a second concrete structural element to be added, wherein said rods are of unequal diameter, the rod having the larger diameter forming the anchoring part and the other length of reinforcing steel with smaller diameter forming the connecting part.

23. A connection according to claim 22, wherein the reinforcing steel rod forming the connecting part has a greater length than the reinforcing steel rod forming the anchoring part.

* * * * *